US006069640A

United States Patent [19]

Kubatzki

[11] Patent Number: 6,069,640

[45] Date of Patent: May 30, 2000

[54] CONFIGURATION FOR SUPPLYING INK TO AN INK JET PRINT HEAD

[75] Inventor: Ralf Kubatzki, Berlin, Germany

[73] Assignee: Francotyp Postalia AG & Co, Birkenwerder, Germany

[21] Appl. No.: 08/987,552

[22] Filed: Dec. 9, 1997

[30] Foreign Application Priority Data

Dec. 9, 1996 [DE] Germany ..... 196 51 050

[51] Int. Cl.[7] ..... B41J 2/175

[52] U.S. Cl. ..... 347/85

[58] Field of Search ..... 347/85, 86, 87, 347/50, 49, 40

[56] References Cited

U.S. PATENT DOCUMENTS

| | | | |
|---|---|---|---|
| 4,074,284 | 2/1978 | Dexter et al. | 347/49 |
| 4,542,386 | 9/1985 | Delligatii et al. | 347/54 |
| 5,030,973 | 7/1991 | Nonoyama et al. | 347/93 |
| 5,670,998 | 9/1997 | Shimoda et al. | 347/50 |
| 5,757,402 | 5/1998 | Günther et al. | 347/49 |
| 5,850,240 | 12/1998 | Kubatzki et al. | 347/49 |
| 5,870,118 | 2/1999 | Günther et al. | 347/49 |

FOREIGN PATENT DOCUMENTS

| | | |
|---|---|---|
| 0383558A1 | 8/1990 | European Pat. Off. . |
| 33 35 614 A1 | 4/1985 | Germany . |
| 44 43 254 C1 | 12/1995 | Germany . |
| 44 43 244 A1 | 5/1996 | Germany . |
| 44 43 245 A1 | 5/1996 | Germany . |

OTHER PUBLICATIONS

German Utility Model DE 295 21 128 U1, dated Oct. 2, 1996, arrangement for an inkjet printer head with piezo planar technique.

Japanese Patent Abstract No. 5–116277 (Shimada), dated May 14, 1993.

*Primary Examiner*—N. Le
*Assistant Examiner*—Michael Nghiem
*Attorney, Agent, or Firm*—Herbert L. Lerner; Laurence A. Greenberg

[57] ABSTRACT

The ink jet print head has a single module or a plurality of modules in a stacked construction and it operates on the edgeshooter or the sideshooter principle. A common supply conduit for the ink conduits of the ink jet printing chambers is provided. A ribbon conductor, which connects to the print head control is also embodied as an ink conductor, which communicates on one end with a common supply conduit in the ink jet print head and on the other with an ink tank. At least one ink conduit is formed into the ribbon conductor. The ribbon conductor comprises a first part, secured to the ink jet print head, and a second part, outside the ink jet print head. The two parts may merge directly with one another or be connected to one another by a plug connector. A pressure equalization diaphragm and a replaceable filter are provided in the transition region between the ribbon conductor and the ink jet print head.

10 Claims, 5 Drawing Sheets

CONFIGURATION FOR SUPPLYING INK TO AN INK JET PRINT HEAD

BACKGROUND OF THE INVENTION

1. Field of the Invention

The invention relates to a configuration for supplying ink to an ink jet print head, in particular an ink jet print head composed of a plurality of stacked modules.

Such ink jet print heads are used both in office printers and in small high-speed printers—of the kind needed for postage meters and product labeling devices—and as a rule have a relatively large number of jets.

Precisely in this latter application, high reliability is demanded, so that mistakes in printing that can have major cost consequences are averted. One component that has an especially great influence on the reliability of a printer is the ink jet print head, along with its supply.

It is a well known principle that the reliability of components increases as the number of individual parts decreases. This is where the invention sets in.

2. Description of the Related Art

It has been known—see German patent disclosures DE 44 43 244 A1 and DE 44 43 245 A1, and U.S. Pat. No. 4,703,333—to connect at least one ribbon conductor to each module of an ink jet print head composed of a plurality of ink jet printing modules. The printing operation is thereby controlled from a central point and the current is supplied via a ribbon conductor.

In U.S. Pat. No. 4,703,333, each module has a number of jets and comprises a plurality of stacked plates with ink jet printing chambers and ink supply conduits machined into them. The module is a so-called sideshooter. This means that the nozzle conduits or openings are guided crosswise through an outer plate. The pressure wave in the ink jet printing chamber extends in the direction of the jet conduit, so that the ink droplets are expelled orthogonally to the plate. Correspondingly, ink inlet conduits and openings for the ink supply are provided crosswise through the outer plate on the opposite side of the module. To that end, an inlet connecting stub is mounted onto the plate above each ink inlet opening. The inlet connecting stubs, located in a row, of all the modules communicate with an ink tank via a common adapter with a following ink hose. The adapter is embodied as a fluid distributor element. Connecting stubs, which are slipped into the inlet connecting stubs of the modules, are located on its ink outlet side. On its ink inlet side is a connecting stub onto which the ink hose is slipped.

The problem of equalizing pressure for the ink inlet remains unaddressed in that disclosure.

For this ink jet print head, a scale-like configuration of the modules is necessary. On the one hand, an unhindered expulsion of ink via a side wall should be possible—because it is the sideshooter type—and on the other, enough space should be available for the ink inlet. Overall, this means that a correspondingly large amount of space is needed.

A multicolor ink jet printer with a movable ink jet print head is also known—see German patent disclosure DE 33 35 614 A1—in which on the one hand fixed ink lines lead from the various ink tanks to the ink jet print head, and on the other, flexible hoses lead from the air spaces above the ink chambers in the ink tanks to the outer wall of the printer; outside the ink tank, the hoses are joined together on the order of a ribbon cable.

Because of the rigid connection between the ink tanks and the ink jet print head, all the ink tanks must be moved in common together with the ink jet print head. This is problematic, given such a relatively large mass.

Ink jet print heads comprising individual modules in a stacked construction that operate by the edgeshooter principle is known as well in the prior art. See German patent DE 44 43 254 C1. The single module comprises three plates one above the other. When the modules are joined into an ink jet print head, spacer parts are also inserted between adjacent modules. Nothing further is tought about how the ink is supplied.

A configuration for an ink jet print head of the piezoelectric planar type is also known—see German Utility Model DE 295 21 128 U1, in which plates are also layered one above the other, and ink supply conduits, ink jet printing chambers, nozzle conduits and nozzle openings are machined into them. The ink supply conduits are supplied from a common supply conduit.

Finally, an ink jet printer is known from Japanese patent disclosure JP 5-116277 A1, in which a separate ink ribbon conductor and a separate electrical ribbon conductor are secured, one above the other, by means of a snap clip to a carriage that additionally carries the ink jet print head. The electric ribbon conductor serves the purpose of electrical supply and triggering of the ink jet print head. The ink ribbon conductor serves to supply the ink jet print head with fresh ink via an intermediate reservoir and to dispose of old ink.

SUMMARY OF THE INVENTION

It is accordingly an object of the invention to provide an ink jet print head ink supply configuration, which overcomes the above-mentioned disadvantages of the heretofore-known devices and methods of this general type and which makes do with as few individual components as possible. It should be possible for the ink jet print head to comprise either a single module or a plurality of modules in a stacked construction; it should be possible to use modules on the edgeshooter principle as well as those on the sideshooter principle. The point of departure is intended to be a module that has a common supply conduit for the ink conduits of the ink jet printing chambers.

With the foregoing and other objects in view there is provided, in accordance with the invention, a configuration for supplying ink to an ink jet print head, comprising:

an ink jet print head with a common ink supply conduit for receiving ink from an ink supply;

a ribbon conductor electrically connected to the ink jet print head for electrically controlling the print head and fluidically communicating with the common ink supply conduit in the print head for supplying the print head with ink.

In accordance with an added feature of the invention, the ribbon conductor has at least one ink supply conduit formed therein.

The embodiment of a ribbon conductor, otherwise provided only with electrical connecting lines, as an ink conductor as well results in a synergistic effect. Because at least one ink conduit is jointly formed into the ribbon conductor, on the one hand an especially compact structure is attained, and on the other the disposition of a pressure equalization diaphragm directly on the ink jet print head is made possible.

Because of the compact structure, possible distortions in the printed image from changes in speed of the recording carrier moved past the ink jet print head are minimized.

Because the pressure equalization diaphragm is disposed directly on the ink jet print head, pressure fluctuations are compensated for faster and better, and a draft in the jets is more successfully counteracted than if the pressure equalization diaphragm were present only in the ink tank.

In accordance with an additional feature of the invention, the system also comprises a pressure equalization diaphragm and a replaceable filter disposed in a transition region between the ribbon conductor and the ink jet print head.

In accordance with another feature of the invention, the ribbon conductor comprises a first part secured to the ink jet print head, and a second part outside the ink jet print head.

In accordance with a further feature of the invention, the first and second parts of the ribbon conductor merge directly with one another, and the first part defines a coupling region between the ink conduit and the common supply conduit. In this embodiment there is also provided a pressure equalization diaphragm and a replaceable filter disposed in the coupling region between the ink conduit and the common supply conduit.

In an alternative embodiment, there is provided a plug connector connecting the first and second parts of the ribbon conductor, the plug connector having electrical connecting elements, fluid connecting elements, and a connector part. The pressure equalization diaphragm and the replaceable filter are thereby disposed in the connector part remote from the ink jet print head, and the fluid connecting element communicates with the common supply conduit in the connector part.

In accordance with again an added feature of the invention, the first part of the ribbon conductor is mounted directly on the ink jet print head, and including connecting lines bonded to associated conductor tracks, and a connecting stub disconnectably connecting the ink conduit with the common supply conduit in the ink jet print head.

In accordance with again a further feature of the invention, the connecting stub is formed with a middle flange and the middle flange has a recess formed therein, and including a resilient collar formed onto the first part, the collar extending orthogonally to the ink conduit and resting in force-lock on a sealing ring disposed in the recess of the middle flange; the connecting stub is mounted orthogonally to the ink jet print head above the common supply conduit; and a portion of the first part of the ribbon conductor located above the collar is a pressure equalization diaphragm.

Furthermore, the pressure equalization diaphragm and the filter may be removably fitted into the fluid connecting elements.

In accordance with again an additional feature of the invention, the ink jet print head comprises a plurality of substantially identical stacked modules each having a common supply conduit. The common supply conduits of the modules communicate with one another, preferably through elastic connecting pieces fluidically connecting the supply conduits to one another.

If the ribbon conductor is split into one part secured to the ink jet print head and one part located outside the ink jet print head and the two parts are connected to one another by a plug connector, once again synergistic effects are obtained.

Embodying the plug connector with electrical and fluidic connecting elements makes possible an especially advantageous integration of an easily removable insert with a replaceable filter and a pressure equalization diaphragm.

Small particles that occur in the ink line are effectively filtered out, and the jets are thus protected against clogging.

If the ink jet print head is equipped with a cleaning module, as has already been proposed in European Patent Disclosure EP 0 749 837, then advantageously more than one ink conduit can be formed into the ribbon conductor, and of these one ink conduit can be used as an ink line to an old ink tank.

Other features which are considered as characteristic for the invention are set forth in the appended claims.

Although the invention is illustrated and described herein as embodied in a configuration for supplying ink to an ink jet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
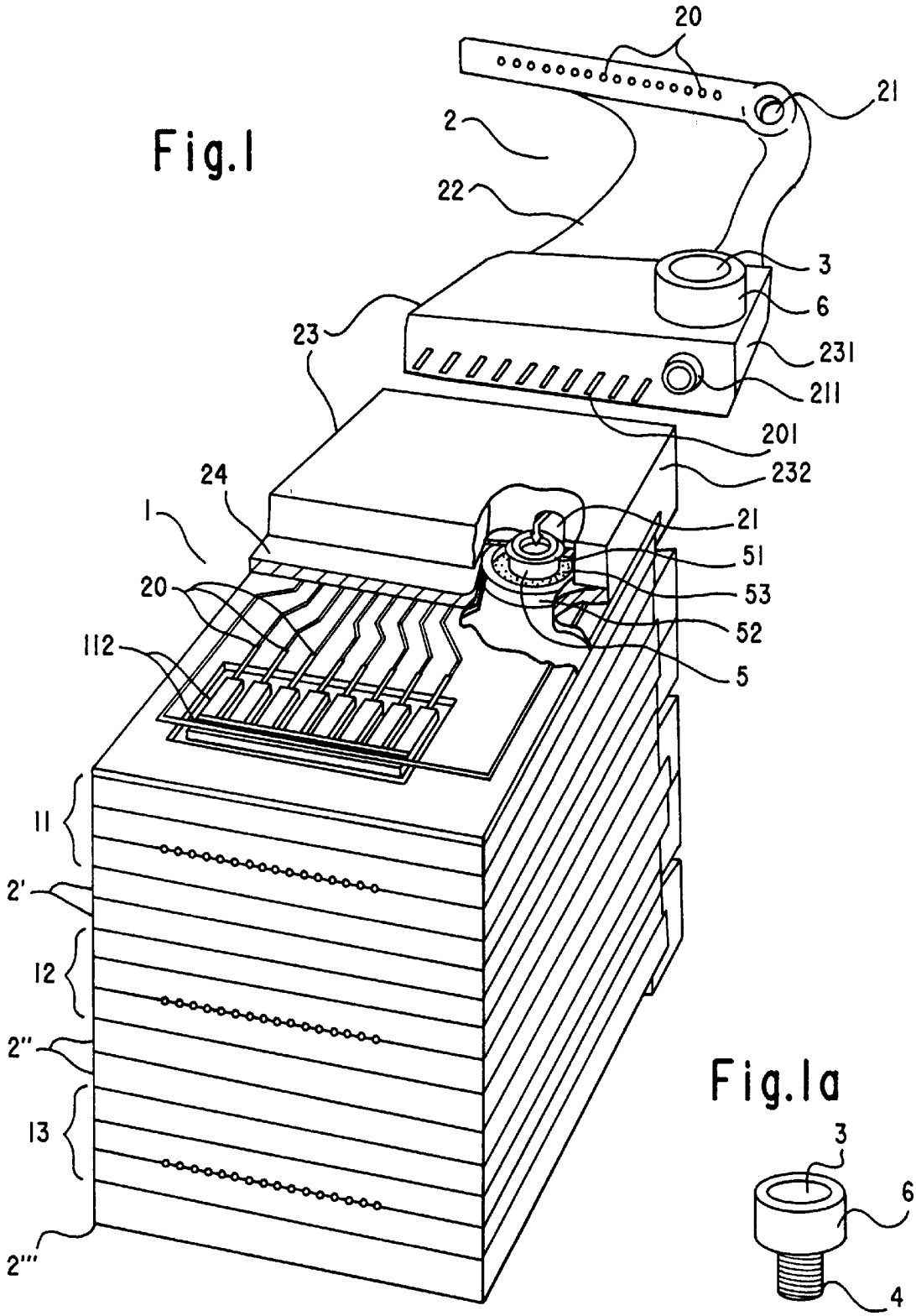
FIG. 1 is a perspective, partly broken-away view of an ink jet print head comprising three modules, with a ribbon conductor and plug connector.
Figure 1A:
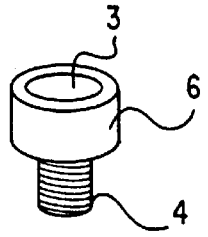

Referring now to the figures of the drawing which, for the sake of simplicity and for easier comprehension are partly schematic, there is seen an ink jet print head 1 which is composed of three modules 11, 12, 13. The modules 11, 12, 13 are spaced apart from one another by two ribbon conductors 2', 2" each, as already proposed in German patent disclosure DE 44 43 244 A1.

The ribbon conductor 2 is brought up to the first module 11 and comprises two parts 22, 24. The two parts 22, 24 are connected to one another by a plug connector 23.

The first part 24 of the ribbon conductor 2 is secured to the module 11.

As can be seen particularly for the second part 22 of the ribbon conductor 2, the ribbon conductor 2 includes a plurality of connecting lines 20 and one ink conduit 21. Correspondingly, the plug connector 23 in the associated connector parts 231, 232 has the same number of electrical connecting elements 201 and one fluid connecting element 211.

In the connector part 231, by means of a screw connection or in any other suitable way, a socket 6 is inserted, which is closed off at the top by a pressure equalization diaphragm 3 and which contains a replaceable filter 4 in its shaft. The filter 4 protrudes as an adapter part into the ink conduit 21 and into the fluid connecting element 211.

The free ends of the connecting lines 20 of part 24 are bonded to lead tracks 112 of the ink jet printing module 11.

The lead tracks 112 are at the same time coatings of piezoelectric actuators, not shown in further detail, as also already described in the aforementioned reference DE 44 43 244.

As in this same reference, the ribbon conductors 2', 2" between the modules 11, 12, 13 may at the same time be embodied as spacer and adjusting pieces. The modules, including the ribbon conductors, are jointly held together in force-locking fashion.

Figure 2A:
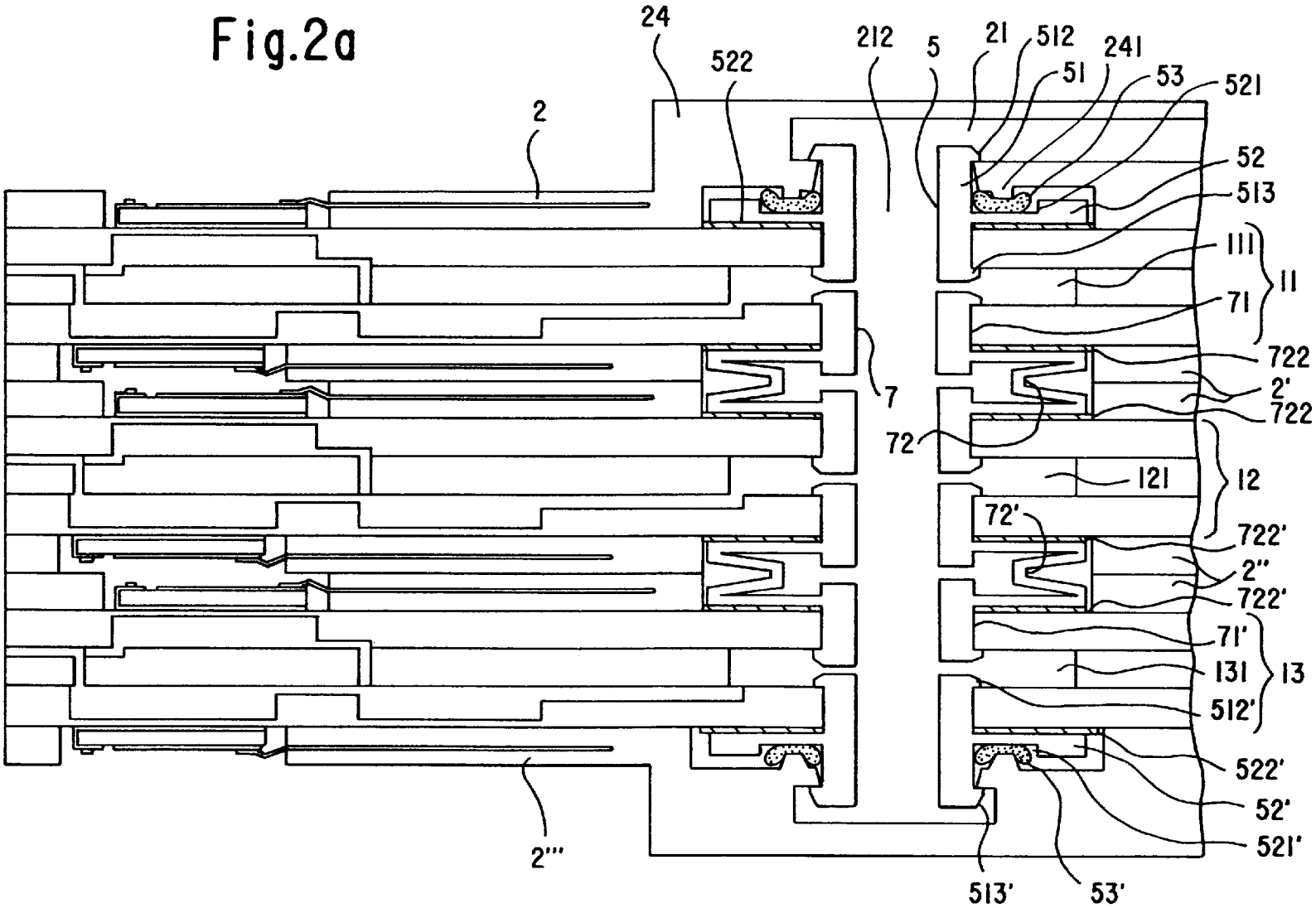
FIG. 2*a* is a longitudinal section through the ink jet print head of FIG. 1.
Figure 2B:
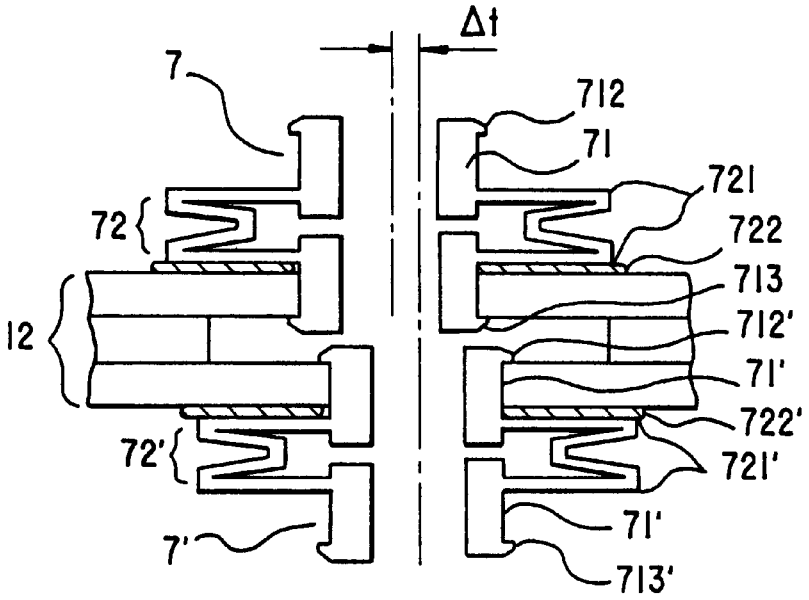
FIG. 2*b* is a longitudinal section through connecting pieces offset from one another.
Figure 2C:
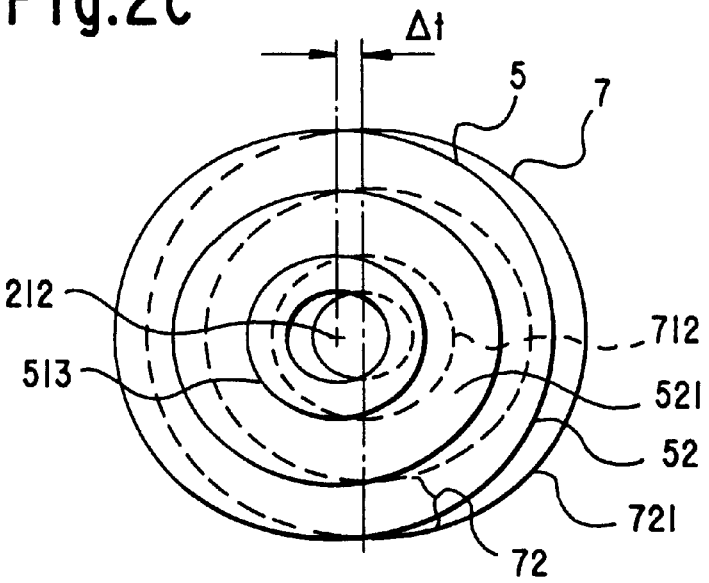
FIG. 2*c* is a plan view on the connecting stub with an elastic connecting piece disposed below it.
Figure 3:
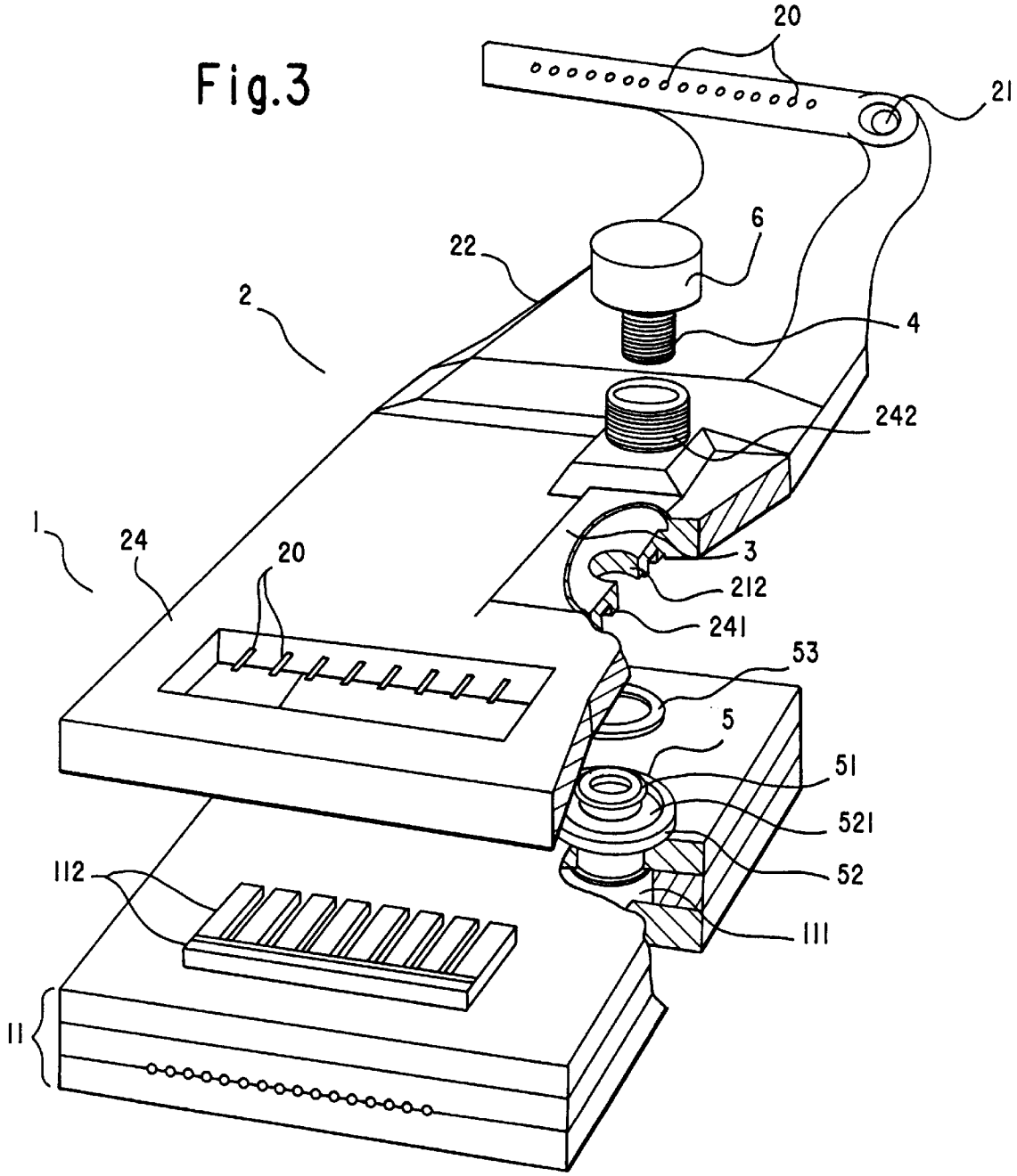
FIG. 3 is a perspective, partly broken-away, and partly exploded view of an ink jet print head with an ink jet printing module having a continuous ribbon conductor.

The ink conduit 21, which comes from the fluid connecting element 211, discharges according to the invention via a connecting stub 5 into a common supply conduit 111 of the module 11; see also FIGS. 2 and 3.

The connecting stub 5 is a component of an elastic connection between the ribbon conductor 2, or its first part 24, and the ink jet print head 1, or its first module 11; see also FIG. 3.

To that end, a resilient collar 241 is formed onto the ribbon conductor part 24 and in the assembled state presses against a sealing ring 53, which is placed in a recess 521 of a middle flange 52 of the connecting stub 5. A coating 522, with which the middle flange rests on the module 11 and 13, respectively, is applied to the opposite side of the middle flange 52.

The coating 522 acts as a seal and if necessary as an adhesive connection. This makes the connection tight.

In FIG. 2*a,* the ink supply to the other modules 12, 13 in the stack is effected by providing that a continuous communication of the common supply conduits 111, 121, 131 with one another exists, on the one hand inside each of the modules, and moreover is provided from module 11 to module 12, and from module 12 to module 13, via intervening connecting pieces 7, 7'.

In this way, the first common supply conduit 111 of the first module 11 communicates with the second common supply conduit 121 of the second module 12.

The second common supply conduit 121 of the second module 12 communicates with the third common supply conduit 131 of the third module 13.

Accordingly, in this embodiment, only the uppermost ribbon conductor 2 is simultaneously embodied as an ink conductor from the ink tank, not identified by reference numeral, to the ink jet print head 1, while the other ribbon conductor parts 24, provided only with openings for the connecting stubs 5 or for the connecting pieces 7, 7', are so-called through conductors and have no ink carrying function.

Each individual connecting piece 7, 7' is embodied as an elastic body, in that its middle part 72, 72' is embodied as bellowslike and flangelike. The faces of the flanges 721, 721' toward the modules 11, 12, on the one hand and 12, 13, on the other, are provided with a respective coating 722, 722', which serves the purpose of sealing and as needed as an adhesive connection; see also FIG. 2*b*.

In this way, the connecting piece 7, 7' rests with its flanges 721, 721' on the modules 11, 12, 13 via the coatings 722, 722', and with collars 71, 71' protruding from the flanges 721, 721', the connecting pieces protrude into openings 212 of the respective modules 11, 12, 13 that lead to the common supply conduits 111, 121, 131. The collar 71, 71' is suitably embodied identically to the connecting stub 5.

The electrical connection of the other ribbon conductors 2', 2", 2'" via the plug connectors 25 to the outside can be done in combined fashion, for instance, via a bus board—not shown in FIG. 1.

The invention is not limited to a special embodiment and by way of example may also be applied to the version shown in German Patent DE 44 23 254 C.

According to the invention, the entire ink jet print head can also be supplied from a single ribbon conductor 2. The ribbon conductor also contacts the aforementioned bus board, which assures the electrical connection for the sake of triggering the various modules.

In this case, platelike one-piece spacer parts are located between the modules 11, 12, 13; the spacer parts need not perform any electrical or fluid supply tasks. The spacer parts merely have openings for the elastic connecting pieces 7, 7'. The elastic connecting pieces 7, 7' assure the supply of ink from module 11 via module 12 to module 13 and are capable, because of their elasticity, of compensating for tolerances among the modules 11, 12, 13.

The connecting stub 5 is also elastic and is thus capable of compensating for slight tolerances in the mounting of the ribbon conductor 2. The connecting stub 5 is mounted on the module 11, to which the ribbon conductor 2 is docked—as already shown in FIG. 1—and which is thus made to communicate with the plug connector part 232, which has the ink conduit 21.

FIG. 2*b* shows a longitudinal section through bores, offset by $\Delta t$ from one another, for the ink conduits in the cover plates of a module 12 as well as correspondingly offset elastic connecting pieces 7, 7', with the ink expulsion direction being toward the observer.

FIG. 2*c* shows a plan view of the connecting stub 5 with the elastic connecting piece 7 disposed below.

To achieve the interlaced principle, the modules 11, 12, 13 are offset from one another in the ink jet print head 1; the offset is adhered to precisely by means of the ribbon conductors 2', 2" or spacer parts. This has already been described in more detail in DE 44 43 244 A2 and DE 44 23 254 C and has the advantage that all the modules may be embodied identically with regard to the outward-pointing surface structure. In the limiting case with a very large number of modules, the offset between adjacent modules will be very small, so that in that case an offset of the bores for the ink conduit in the cover plates is no longer necessary, and the offset between the modules is within the range of elasticity of the elastic connecting pieces 7, 7'.

The invention can also be applied if the modules are of some different design. When there is more than one common supply conduit 111 inside one module 11, all the supply conduits 111 communicate with one another.

However, the invention also allows supplying each module via a ribbon conductor in the same way as the first module. In that case, all the plug connectors are embodied similarly to the plug connector 23, and the spacing between modules 11, 12, 13 is only slightly greater. In such an embodiment, the connecting pieces 7, 7', 7" would be omitted entirely.

In FIG. 3, both parts 22, 24 of the ribbon conductor 2 merge directly with one another; that is, a plug connector is dispensed with. Instead, the first part 24 of the ribbon conductor 2, secured to the module 11, is embodied such that the socket 6 with the filter 4 can be inserted, and a compensation volume along with the pressure equalization diaphragm 3 is available above the inlet region into the common supply conduit 111.

The docking of the part 24 to the module 11 is accomplished analogously to the version of FIG. 1, via the combination of the collar 241, sealing ring 53, and connecting stub 5.

The electrical supply for triggering the piezoelectric actuators may be accomplished separately on the underside of the module.

Figure 4:
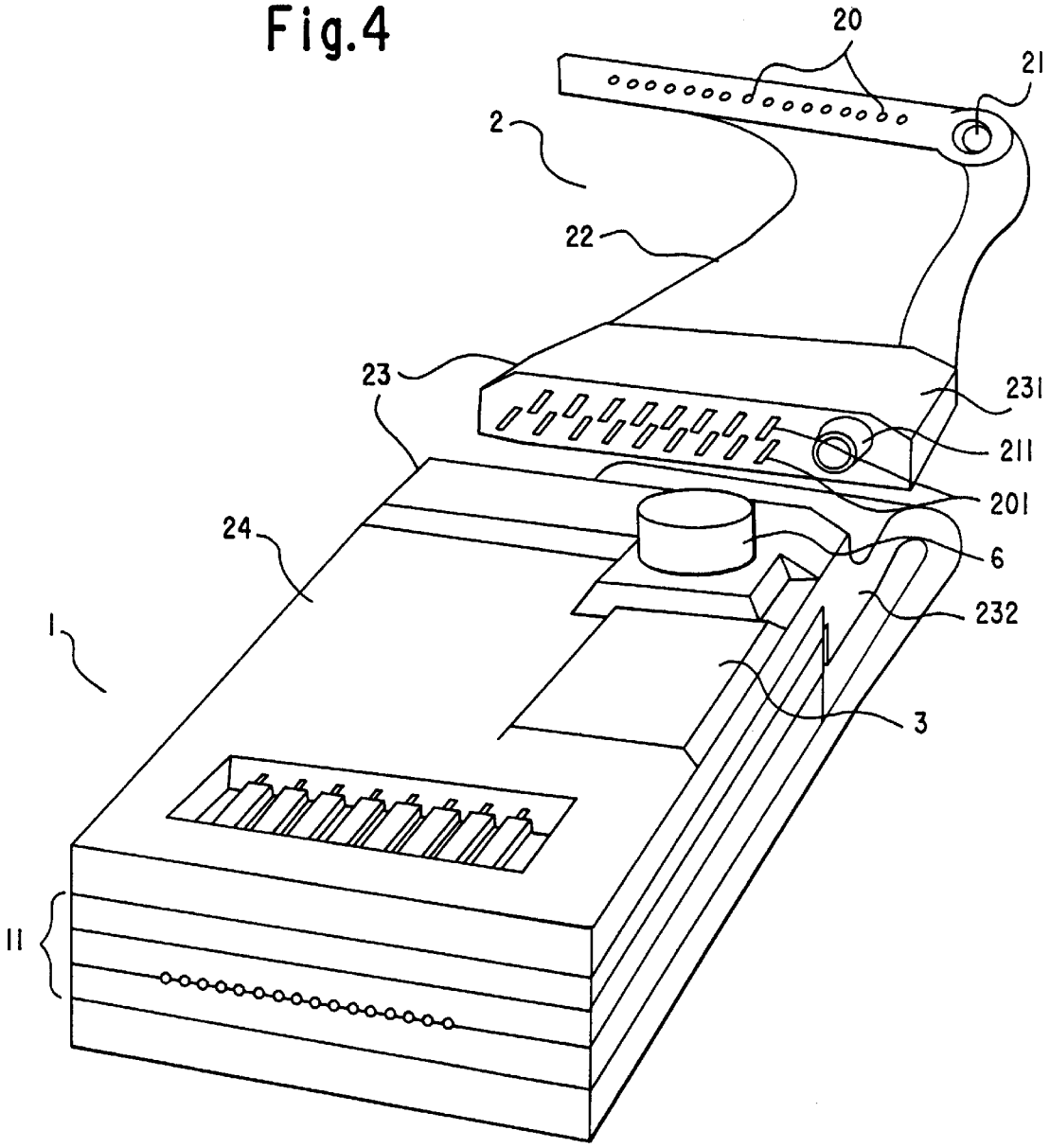
FIG. 4 is a perspective, partly individualized view of an ink jet print head comprising an ink jet printing module with a ribbon conductor and a plug connector.

In FIG. 4, an embodiment is shown in which the two parts 22, 24 of the ribbon conductor 2 are joined to one another via a plug connector 23, but the pressure equalization diaphragm 3 and the filter 4 are disposed as in the version of FIG. 3.

The plug connector 23 is embodied such that the electrical connection to the lower part of the module 11 from the connector part 232 on the module 11 is effected by connecting the lower ribbon conductor 2' to it. The common supply conduit 111 accordingly communicates with a non-illustrated ink tank only via the ribbon conductor 2. The connector part 231 remote from the ink jet print head 1 or module 11 is adapted accordingly, so as to accomplish the electrical supply for triggering the piezoelectric actuators on the underside of the module.

Another, non-illustrated, embodiment dispenses with a plug connector, similarly to the embodiment shown in FIG. 3. Here the ribbon conductor 2 in the head region comprises a ribbon conductor part 24 and 24', which are simply hinged open—like a jaw—for mounting the module 11. Once they close, the mounting process is complete.

Individual ink jet print head modules of this kind may naturally also be advantageously used to make an ink jet print head on the non-interlaced principle as well.

I claim:

1. A configuration for supplying ink to a printer, comprising:

an ink jet print head having a common ink supply conduit for receiving ink;

a ribbon conductor having an ink conduit and being electrically connected to said ink jet print head for electrically controlling said print head, said ribbon conductor including a first part mounted directly on said ink jet print head and a second part disposed remote from said ink jet print head, said first part of said ribbon conductor including connecting lines and conductor tracks, whereby each one of said connecting lines is bonded to an associated one of said conductor tracks;

a connecting stub disconnectably connecting said ink conduit of said ribbon conductor with said common ink supply conduit in said ink jet print head, said connecting stub being formed with a middle flange having a recess formed therein; and a sealing ring disposed in said recess of said middle flange;

said connecting stub mounted orthogonally to said ink jet print head above said common supply conduit, said connecting stub having a resilient collar formed onto said first part of said ribbon conductor, said collar extending orthogonally to said ink conduit for resting in force-lock on said sealing ring disposed in said recess of said middle flange.

2. The configuration according to claim 1, wherein said ribbon conductor has at least one ink supply conduit formed therein.

3. The configuration according to claim 1, which further comprises a pressure equalization diaphragm and a replaceable filter disposed in a transition region between said ribbon conductor and said ink jet print head.

4. The configuration according to claim 1, wherein said first and second parts of said ribbon conductor merge directly with one another, and wherein said first part defines a coupling region between said ink conduit and said common supply conduit, and including a pressure equalization diaphragm and a replaceable filter disposed in said coupling region between said ink conduit and said common supply conduit.

5. The configuration according to claim 1, which further comprises a plug connector connecting said first and second parts of said ribbon conductor, said plug connector having electrical connecting elements, fluid connecting elements, and a connector part, and including a pressure equalization diaphragm and a replaceable filter disposed in said connector part remote from said ink jet print head, and wherein said fluid connecting element communicates with said common supply conduit in said connector part.

6. The configuration according to claim 5, wherein said pressure equalization diaphragm and said filter are removably fitted into said fluid connecting elements.

7. The configuration according to claim 1, wherein:

a portion of said first part of said ribbon conductor located above said collar is a pressure equalization diaphragm.

8. The configuration according to claim 1, wherein said ink jet print head comprises a plurality of substantially identical stacked modules each having a common supply conduit, and wherein said common supply conduits of said modules communicate with one another.

9. The configuration according to claim 8, which further comprises elastic connecting pieces fluidically connecting said common supply conduits to one another.

10. A configuration for supplying ink to a printer, comprising:

an ink jet print head including a plurality of stacked modules each having a common ink supply conduit for receiving ink, said common ink supply conduits of said modules communicating with each other;

elastic connecting pieces fluidically connecting said common ink supply conduits to one another; and a ribbon conductor electrically connected to said ink jet print head for electrically controlling said print head and fluidically communicating with said common ink supply conduits in said print head for supplying said modules with ink.

* * * * *